US007444749B1

(12) United States Patent
Chen

(10) Patent No.: US 7,444,749 B1
(45) Date of Patent: Nov. 4, 2008

(54) ROTARY KNIFE

(76) Inventor: Shan-Ming Chen, No. 1-6, Lane 2, Puta Road, Fongtzer Village, Puyen Hsiang, Changhua Hsien (TW)

( * ) Notice: Subject to any disclaimer, the term of this patent is extended or adjusted under 35 U.S.C. 154(b) by 171 days.

(21) Appl. No.: 11/466,060

(22) Filed: Aug. 21, 2006

(51) Int. Cl.
*B26B 29/02* (2006.01)
*B26B 25/00* (2006.01)

(52) U.S. Cl. ..... 30/292; 30/307; 30/317

(58) Field of Classification Search ..... 30/286, 30/289, 292, 293, 307, 319
See application file for complete search history.

(56) References Cited

U.S. PATENT DOCUMENTS 4,432,137 A * 2/1984 Okada ..... 30/292
4,601,103 A * 7/1986 Sugiyama ..... 30/162
5,493,781 A * 2/1996 Saito ..... 30/292
6,094,824 A * 8/2000 Takeshita ..... 30/292
6,282,794 B1 * 9/2001 Cho et al. ..... 30/292
6,327,783 B1 * 12/2001 Ming ..... 30/292
7,073,263 B2 * 7/2006 Kawasaki ..... 30/292
7,290,340 B2 * 11/2007 Lin ..... 30/292
2007/0022615 A1 * 2/2007 Tsai-Lian ..... 30/319

* cited by examiner

*Primary Examiner*—Hwei-Siu C Payer
(74) *Attorney, Agent, or Firm*—Egbert Law Offices

(57) ABSTRACT

A rotary knife apparatus has first and second protecting strips placed on both sides of a joint end of a blade of the rotary knife, and two protecting strips placed on the same base tube as a rotating point. A bi-fork braking component is used to control its opening. A toggle control component is placed on one end of the bi-fork braking component that faces the direction of a grip, and the end faces a joint end has a first and second acting fork. The first and second acting forks are connected to the first and second protecting strips so that the toggle control component can be moved back and forth to drive the two protecting strips close and separate.

5 Claims, 7 Drawing Sheets

ROTARY KNIFE

The present invention relates generally to an improved structure of a rotary knife, and more particularly to a knife that covers the blade for safety purposes.

A rotary knife is a cutting tool, and its primary use is to cut paper. The difference between a rotary knife and regular pen knife is that the blade of rotary knife is round. When it is used, its round blade is pressed against the paper when rolling to cut the paper.

Because the blade of the rotary knife is round, when the blade is not being used, it cannot be folded like the regular pen knife. The placement of the blade of conventional rotary knife has a movable cover that can be pushed aside, so that the user can cover the blade by pushing the cover forward to cover the blade. The conventional design can only cover one side of the blade, and it cannot actually cover the edge of the blade, which is not at all safe. If the user's finger touches the part of blade that is not covered, it can be cut by the edge of the blade.

Thus, to overcome the aforementioned problems of the prior art, it would be an advancement of the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The present invention primarily has the first and second protecting strips 21, 22 placed on both sides of the joint end 12 of the blade of the rotary knife A. The two protecting strips oscillate based on the same base tube 13 as a rotating point, using a bi-fork braking component 30 to control its opening. By so doing, the toggle control component 33 of the bi-fork braking component 30 can be used to drive the two protecting strips 21, 22 to close or to separate. When the two protecting strips 21, 22 are closed, it covers the protruding part of blade 61 of the round blade 60. When they are separated, the round blade 60 can cut. By so doing, a movement is created that is different than the conventional rotary knife structure, which is creative and meets the consumer's demand.

When the two protecting strips 21, 22 are closed, their curved edges 211, 221 can be connected into an arch wall to cover the front half part of the blade 61 of the round blade 60. So the blade 61 of the round blade 60 can be covered, which can prevent cutting injury from happening should the user touch the round blade 60 from either direction.

Protruding support block 35 is placed at the bottom between the toggle control component 33 and the first and second acting forks 31, 32. The toggle control component 33 can be pushed up in the air, which creates space for the toggle control component so that it may be pressed down.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
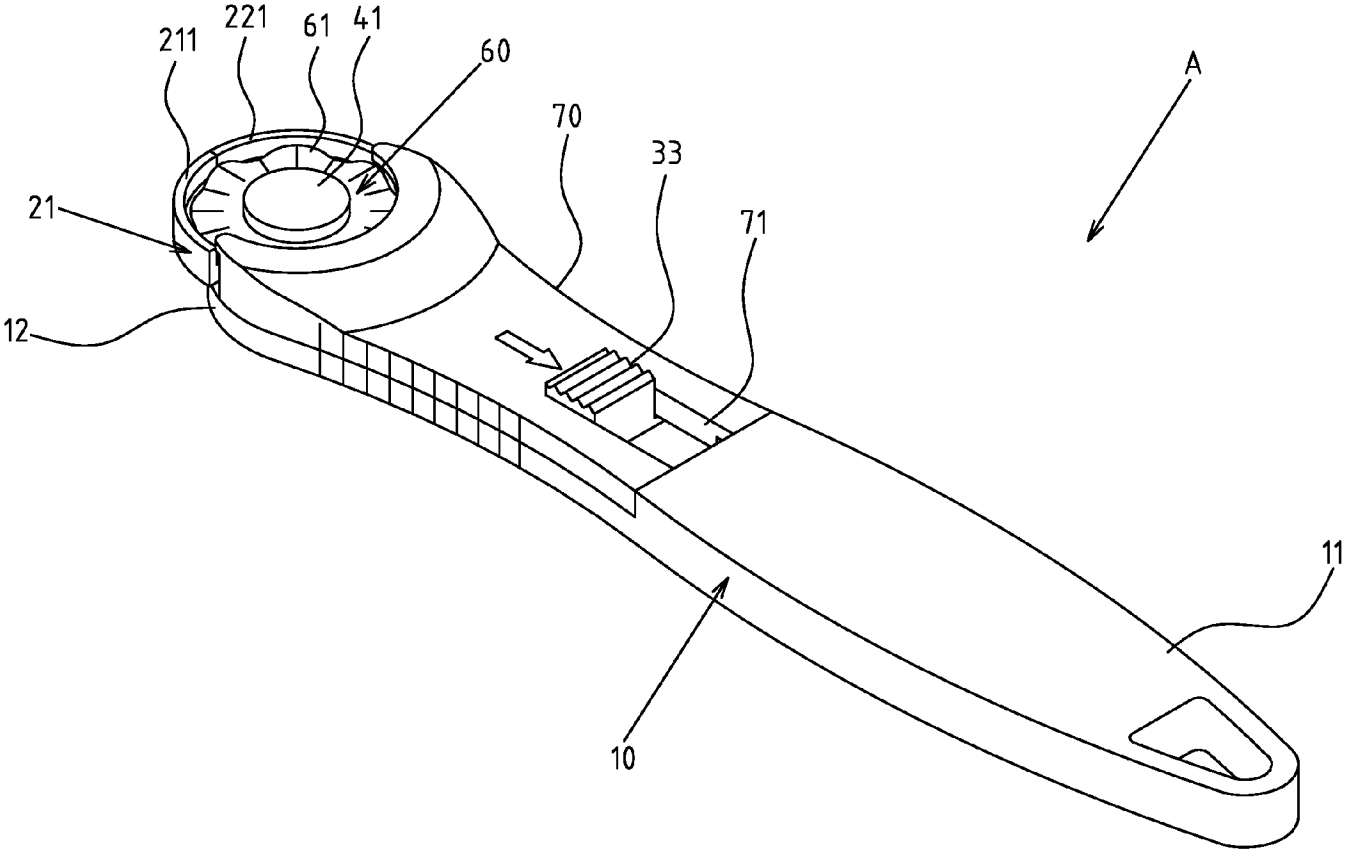
FIG. 1 shows an assembled perspective view of the preferred embodiment of the present invention.
Figure 2:
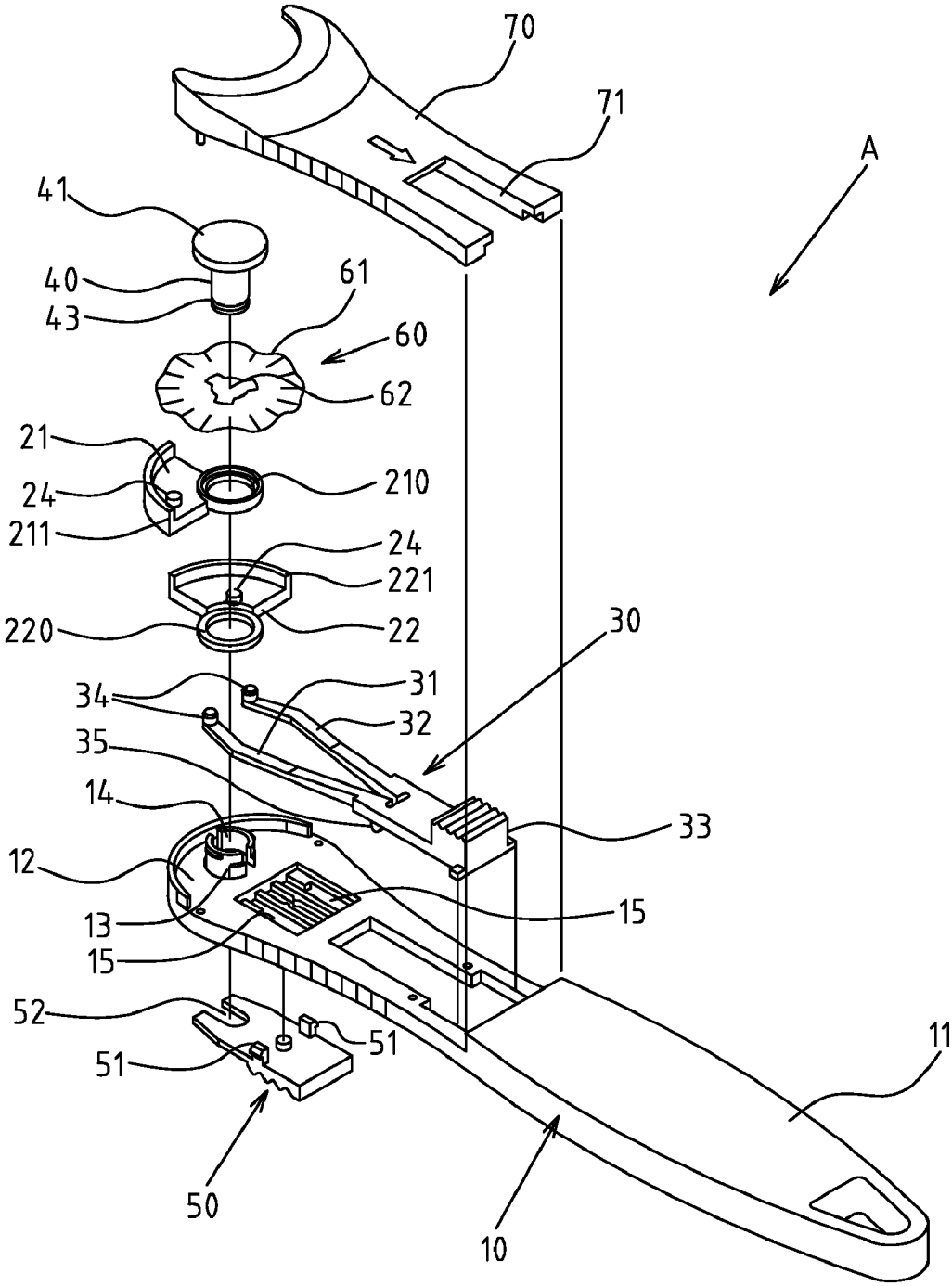
FIG. 2 shows an exploded perspective view of the preferred embodiment of the present invention.
Figure 3:
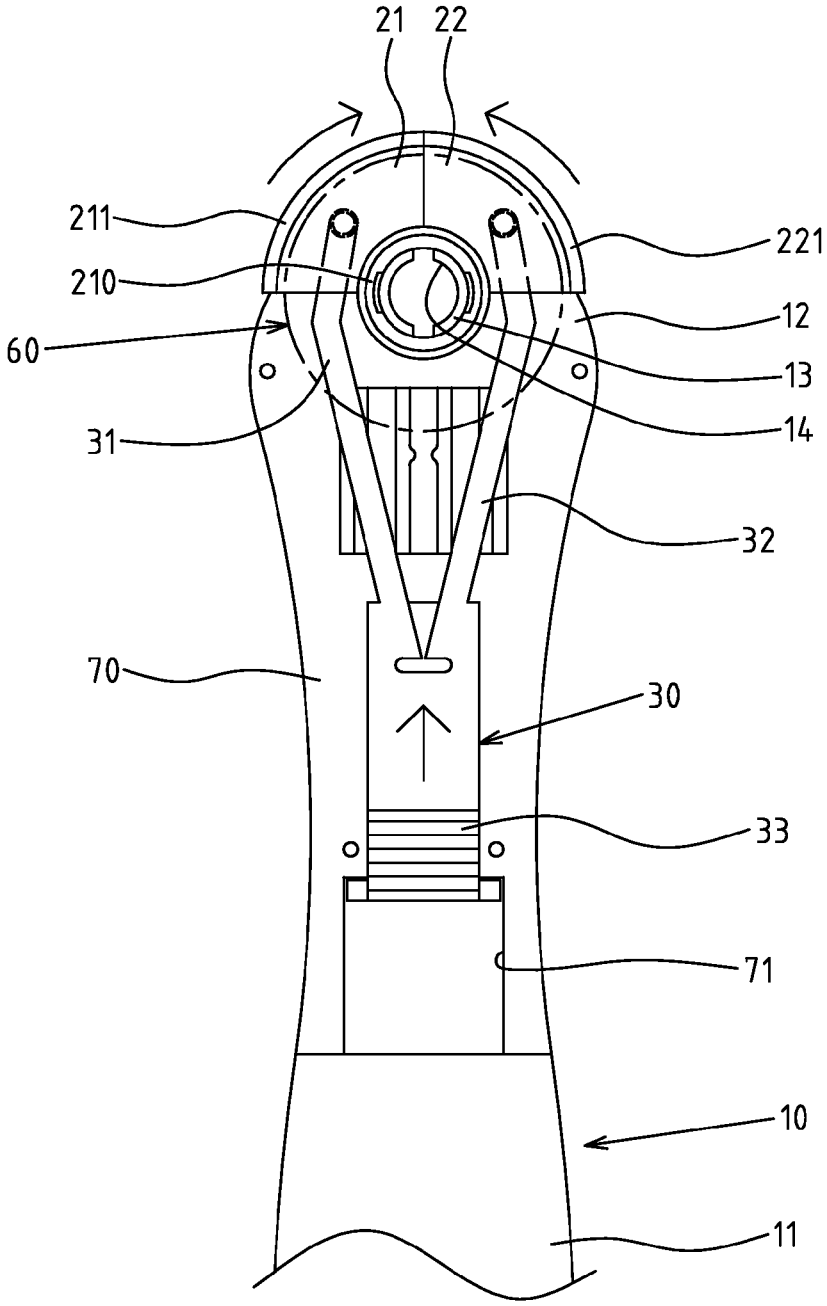
FIG. 3 shows a top plan view of the operation of the present invention.

As shown in FIGS. 1-3, there is an improved structure of rotary knife embodied in the present invention.

The rotary knife A mentioned herein comprises a round knife body 10, which includes a grip 11 and a joint end 12. A base tube 13 is placed at a predetermined area on the joint end 12, and a through hole 14 is placed in the center of the base tube 13.

A first protecting strip 21 and a ring sleeve 210 are placed on one end. A curved edge 211 is placed on the other end, and the first protecting strip 21 is connected to the base tube 13 mentioned above through ring sleeve 210. The first protecting strip moves using base tube 13 as a rotating point.

A second protecting strip 22 and a ring sleeve 220 are placed on one end, and a curved edge 221 is placed on the other end. The second protecting strip 22 is connected to the base tube 13 mentioned above through the ring sleeve 220. The second protecting strip 22 moves using base tube 13 as a rotating point and makes the second protecting strip 22 set symmetrically with the first protecting strip 21.

A bi-fork braking component 30 is placed on the predetermined end between the grip 11 of the rotary knife 10 and the joint end 12. The bi-fork braking component 30 has a toggle control component 33 towards grip 11, and the end that faces joint end 12 has a first acting fork 31 and the second acting fork 32. The end of the first acting fork 31 is connected to the end of the first protecting strip 21 that has a curved edge 211. The end of the second acting fork 32 is connected to the end of the second protecting strip 22 that has curved edge 221. The parts where the first and the second acting forks 31, 32 are connected to the protecting strip 21, 22 can be the combination for the round protruding rod 34 and round hole 24.

Figure 5:
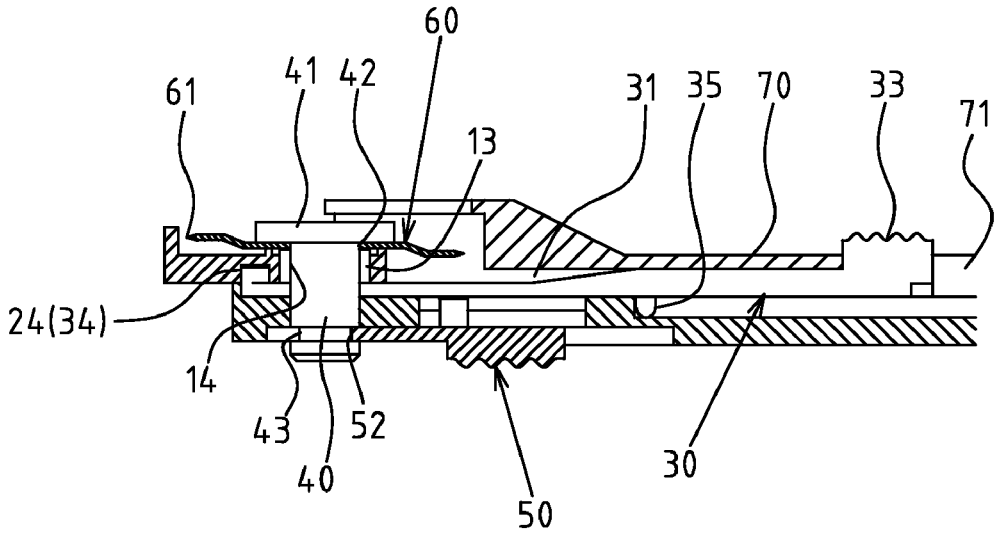
FIG. 5 shows a sectional view of the partial structure of the present invention.

A bolt shaft 40 is placed in the through hole 13 of the base tube 13 mentioned above, and one of its ends is the bolt 41 that expands the diameter to block the first and second protecting strips 21, 22 mentioned above. The other end of bolt shaft 40 goes through the through hole 14 of the base tube 13, and is positioned by the positioning component 50. Moreover, the end of the bolt shaft 40 that is close to the bolt 41 has a blade cover section 42 (as shown in FIG. 5).

A round blade 60 is round plate like. Its edge is the blade 61 part and has a hole 62 in the center. The round blade 60 can be placed in the blade cover section 42 of the bolt shaft 40 mentioned above through the hole 62.

A limit cap 70 is placed on the outer part of the bi-fork braking component 30 that corresponds to one side of the rotary knife 10 to limit the bi-fork braking component 30.

The ends of the first and second protecting strips 21, 22 that have curved edges 211, 221, can be a quarter of the round plate.

The toggle control component 33 of the bi-fork braking component 30 and the first and second forks 31, 32 can be formed in single one piece plastic injection process.

Figure 7:
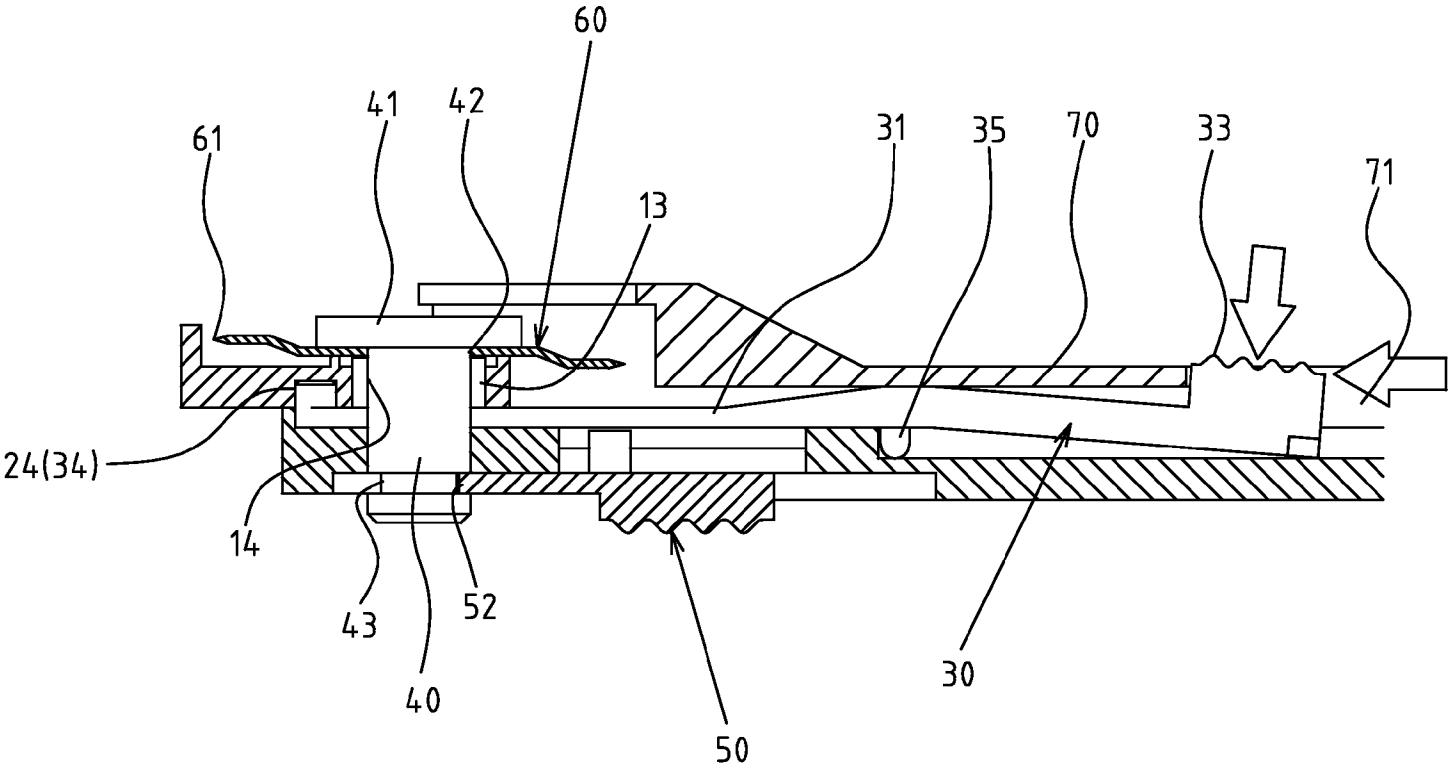
FIG. 7 shows an elevation view of the operation of the toggle control component of the preferred embodiment of the present invention.

The toggle control component 33 of the bi-fork braking component 30 can be a button that protrudes out of the limit cap 70 and an opening 71 is made in the limit cap 70 for the toggle control component 33 to protrude out for user to operate. A protruding support block 35 can be placed at the predetermined area between the toggle control component 33 and the first and second acting forks 31, 32. By so doing, the toggle control component 33 is supported up in the air, and creates a space so that toggle control component 33 may be pushed down, as shown in FIG. 7. The objective of this design is to use the advantages that toggle control component 33 can be pressed down to create the fraction when the user pushes, which makes operation easier.

Figure 6:
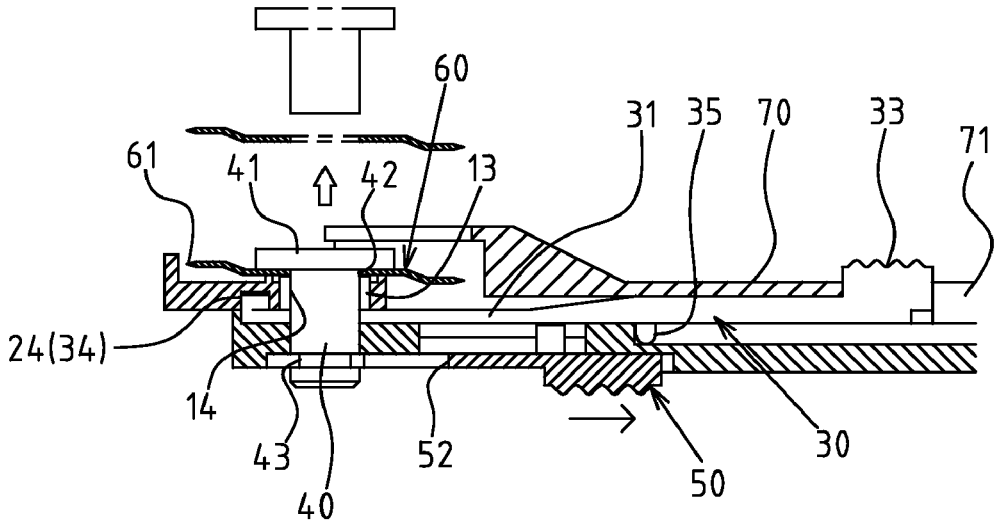
FIG. 6 shows a sectional view of the blade of the preferred embodiment of the present invention being disassembled.

The bolt shaft 40, that reaches to the positioning component 50 at the other end of the through hole 14 of the base tube 13, can be slidable. One end of the positioning component 50 of the present invention has two hooks 51 to make the two long guide slots 15 at the corresponding position of the rotary knife 10 for the hook 51 mentioned above to slide back and forth. An indent groove 52 is placed at the end of the positioning component 50 so that a ring groove 43 placed at the end of the bolt shaft 40 can be connected by the indent groove 52 mentioned above. By so doing, when the indent groove 52 of the positioning component 50 is connected to the ring groove 43 of the bolt shaft 40 (as shown in FIG. 5), it positions the bolt shaft 40 while still being rotatable. When the user moves the positioning component 50 back (which is in the direction of the grip 11 of the rotary knife 10), the indent groove 52 breaks off from the ring groove 43 of the bolt shaft 40 (as shown in FIG. 6). At this time, the bolt shaft 40 is in a position such that the through hole 14 of the base tube 13 may be removed to change the round blade 60.

Through the above structure and design, the operation of the present invention is explained.

Figure 4:
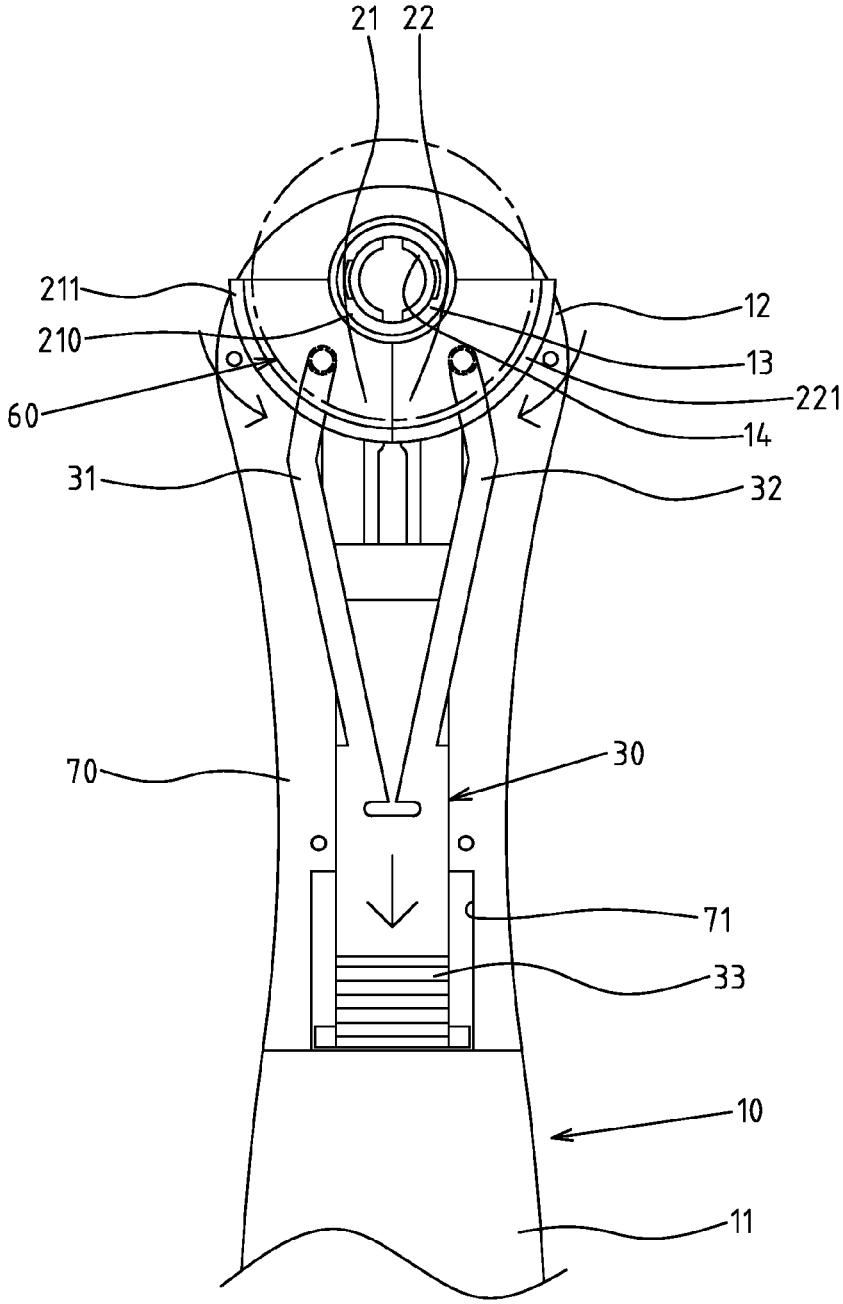
FIG. 4 shows another top plan view of the operation of the present invention.

As shown in FIG. 3 and also FIGS. 1 and 2, when the user moves the toggle control component 33 of the bi-fork braking component 30 forward, which is in the direction of the joint end 12 of the rotary knife 10, it moves the first acting fork 31 and the second acting fork 32 at the same time. At this time, the first and second protecting strips 21, 22 are moved by the first and second acting forks 31, 32. The first and second acting forks 31, 32 oscillate using the base tube 13 as a base. When the first and second protecting strips 21, 22 are leaning against each other, the curved edges 211, 221 will connect to make an arch wall to cover the front half part of the blade 61 of the round blade 60 for safety. As shown in FIG. 4 and FIG. 2, when the user moves the toggle control component 33 of the bi-fork braking component 30 backward (which is in the direction of grip 11 of the rotary knife 10), it moves the first acting fork 31 and the second acting fork 32 backwards at the same time. At this time, the first and second protecting strips 21, 22 are moved by the first and second acting forks 31, 32. The first and second acting forks 31, 32 oscillate using the base tube 13 as base, when the first and second protecting strips 21, 22 is separating from each other. The front half part of the blade 61 of the round blade 60 will protrude over the joint end 12 of the blade for cutting.

Figure 8:
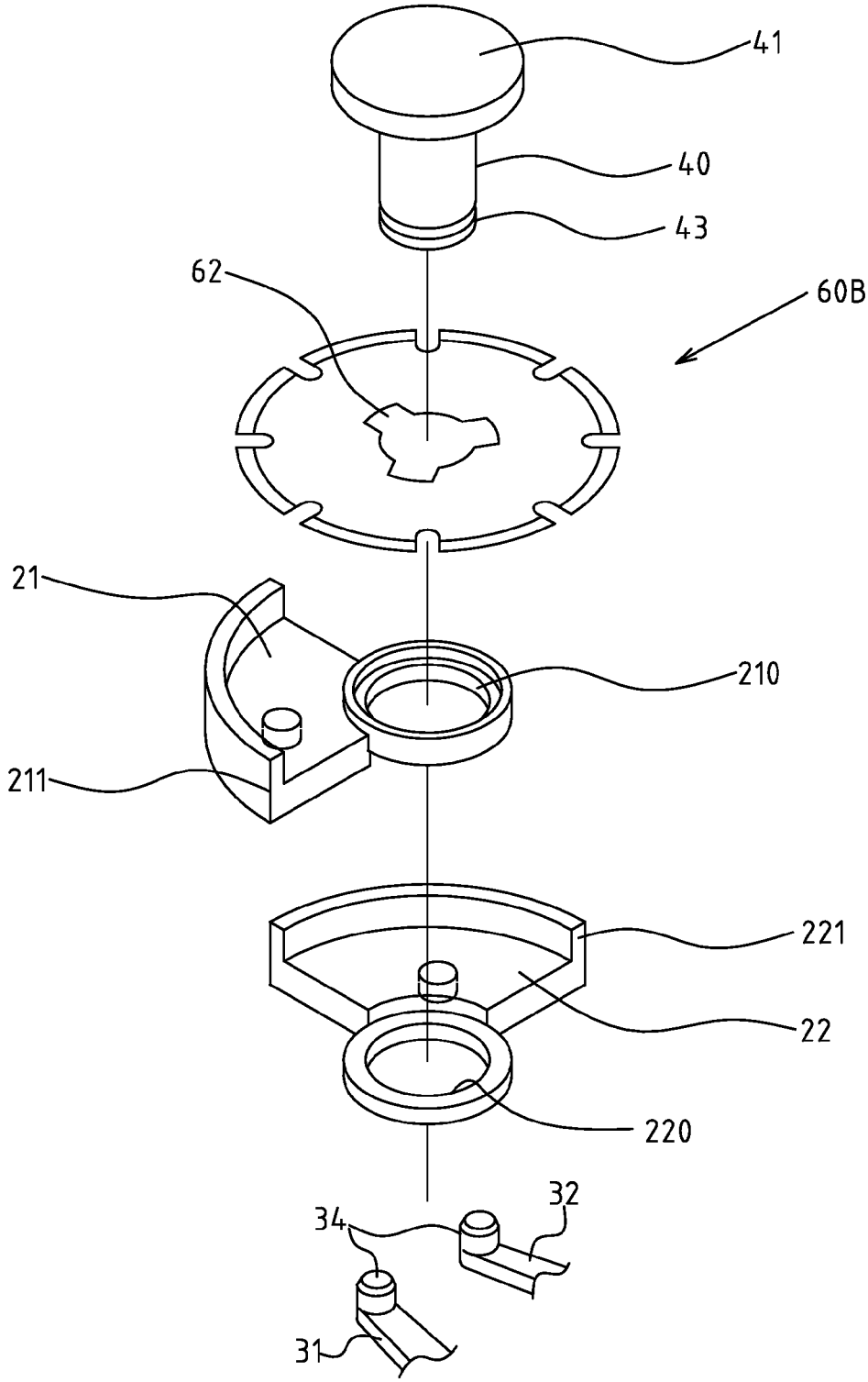
FIG. 8 shows a perspective view of another embodiment of the blade of the present invention.

As shown in FIG. 8, there is another embodiment of the round blade of the present invention. The blade 61 of the round blade 60 of the present invention is wave shaped, and the blade of the round blade 60B disclosed in FIG. 8 has a flat edge.

I claim:

1. A rotary knife comprising:

a knife body having a grip and a joint end, said joint end having a base tube thereon, said base tube having a through hole formed in a center thereof;

a first protecting strip having a ring sleeve positioned on one end thereof, said first protecting strip having a curved edge at an opposite end thereof, said first protecting strip being connected to said base tube via said ring sleeve such that said first protecting strip rotates about said base tube;

a second protecting strip having a ring sleeve at one end thereof and a curved edge at an opposite end thereof, said second protecting strip being connected to said base tube via said ring sleeve thereof such that said second protecting strip rotates about said base tube, said second protecting strip being symmetrical to said first protecting strip;

a bi-fork braking component positioned between said grip and said joint end of said knife body, said bi-forking braking component having a toggle control component extending toward said grip, said bi-fork braking component having an end facing said joint end that has a first acting fork and a second acting fork, said first acting fork having an end connected to said curved edge of said first protecting strip, said second acting fork having an end connected to said curved edge of said second protecting strip;

a bolt shaft extending through said through hole of said base tube, said bolt shaft having a bolt head at one end that blocks said first and second protecting strips, said bolt shaft having an end adjacent said bolt head that has a blade cover section thereon; and a round blade having a plate shape and an outer edge, said round blade having a hole in a center thereof, said round blade positioned in said blade cover section.

2. The rotary knife of claim 1, the curved edges of said first and second protecting strips defining an arc of a quarter circle.

3. The rotary knife of claim 1, said toggle control component and said first and second forks being integrally formed together of a polymeric material, said toggle control component being a button protruding through an opening of a limit cap.

4. The rotary knife of claim 3, further comprising:

a protruding support block positioned between said toggle control component and said first and second forks.

5. The rotary knife of claim 1, said bolt shaft being slidable, the rotary knife further comprising:

a positioning component having an indent groove formed at an end thereof, said bolt shaft having a ring groove connected to said indent groove such that said bolt shaft is rotatable in said positioning component.

* * * * *